US011059004B2

(12) United States Patent
Nater et al.

(10) Patent No.: US 11,059,004 B2
(45) Date of Patent: Jul. 13, 2021

(54) DEVICE AND METHOD FOR MIXING, IN PARTICULAR DISPERSING

(71) Applicant: BÜHLER AG, Uzwil (CH)

(72) Inventors: Eduard Nater, Zuckenriet (CH); Achim Philipp Sturm, Niederuzwil (CH)

(73) Assignee: BUEHLER AG, Uzwil (CH)

( * ) Notice: Subject to any disclaimer, the term of this patent is extended or adjusted under 35 U.S.C. 154(b) by 481 days.

(21) Appl. No.: 15/567,125

(22) PCT Filed: Mar. 22, 2016

(86) PCT No.: PCT/EP2016/056216
§ 371 (c)(1),
(2) Date: Oct. 17, 2017

(87) PCT Pub. No.: WO2016/165917
PCT Pub. Date: Oct. 20, 2016

(65) Prior Publication Data

US 2018/0099254 A1 Apr. 12, 2018

(30) Foreign Application Priority Data

Apr. 17, 2015 (EP) ..... 15164059

(51) Int. Cl.
*B01F 7/00* (2006.01)
*B02C 17/16* (2006.01)
*B02C 13/20* (2006.01)

(52) U.S. Cl.
CPC ..... *B01F 7/00608* (2013.01); *B01F 7/0075* (2013.01); *B01F 7/00708* (2013.01);
(Continued)

(58) Field of Classification Search
CPC B01F 7/00608; B01F 7/0075; B01F 7/00775; B01F 7/00783; B01F 7/00791;
(Continued)

(56) References Cited

U.S. PATENT DOCUMENTS 1,483,742 A * 2/1924 Stevens ..... A23D 9/02 554/175
3,195,867 A 7/1965 Mould, Jr.
(Continued)

FOREIGN PATENT DOCUMENTS

DE 1 507 493 7/1971
DE 35 21 668 A1 12/1986
(Continued)

OTHER PUBLICATIONS

International Search Report Corresponding to PCT/EP2016/056216 dated Jul. 5, 2016.
(Continued)

*Primary Examiner* — Adam J Eiseman
*Assistant Examiner* — Stephen Floyd London
(74) *Attorney, Agent, or Firm* — Finch & Maloney, PLLC; Michael J. Bujold

(57) ABSTRACT

A device (1) for mixing which comprises a housing (2) with at least one inlet (3). A first process region (4) mixes the supplied substances which are introduced via the inlet (3) while a second process region (5) discharges the mixture via an outlet (6). A first gap-forming element (7), preferably a rotor, is assigned to the first process region (4) and comprises openings (8), and a second gap-forming element (9), preferably a stator, is assigned to the second process region (5) and corresponds with the first gap-forming element (7), wherein the second gap-forming element (9) comprises openings (10). At least one of the gap-forming elements (7, 9) is rotatable relative to the other gap-forming element (7,
(Continued)

Figure 3:
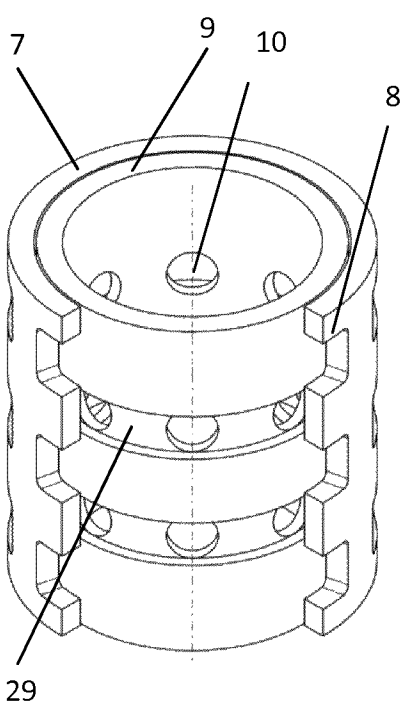

9). The openings (8, 10) of the first and second gap-forming elements (7, 9) are arranged such that a mixture passes through the openings from the first into the second process region.

12 Claims, 12 Drawing Sheets

(52) U.S. Cl.
CPC ..... *B01F 7/00758* (2013.01); *B01F 7/00775* (2013.01); *B01F 7/00783* (2013.01); *B01F 7/00858* (2013.01); *B01F 7/00875* (2013.01); *B02C 13/205* (2013.01); *B02C 17/161* (2013.01); *B02C 17/166* (2013.01)

(58) Field of Classification Search
CPC ..... B01F 7/00833; B01F 7/00858; B01F 7/00816; B01F 7/00875; B02C 13/205; B02C 17/166
See application file for complete search history.

(56) References Cited

U.S. PATENT DOCUMENTS 4,136,971 A 1/1979 Varlamov et al.
4,620,673 A 11/1986 Canepa et al.
5,518,191 A * 5/1996 Bartsch ..... B02C 17/161 241/171
5,749,650 A * 5/1998 Kinney ..... B01F 5/0664 138/43
5,904,308 A * 5/1999 Schnell ..... B01F 7/00758 241/188.2
6,029,853 A 2/2000 Kubo et al.
6,622,950 B1 * 9/2003 Fleming ..... A22C 17/04 241/74
8,794,558 B2 8/2014 Pausch et al.
2003/0209618 A1 * 11/2003 Sneeringer ..... B01F 7/00466 241/172
2005/0047270 A1 * 3/2005 Wood ..... A01K 63/042 366/170.3
2009/0179099 A1 * 7/2009 Stehr ..... B02C 17/16 241/171
2009/0186383 A1 * 7/2009 Mancosky ..... C07H 1/06 435/72
2010/0199645 A1 * 8/2010 Telford ..... B01F 3/04049 60/295
2010/0282886 A1 * 11/2010 Pallmann ..... B02C 13/22 241/261
2011/0168814 A1 * 7/2011 Brook-Levinson ..... B02C 17/161 241/21
2014/0334250 A1 * 11/2014 Brown ..... B01F 7/00816 366/297
2019/0283034 A1 * 9/2019 Berry ..... B02C 13/185

FOREIGN PATENT DOCUMENTS

DE 10 2010 053 484 A1 6/2012
EP 0 376 001 A1 7/1990
EP 0 420 981 A1 4/1991
GB 2088248 A * 6/1982 ..... B02C 13/205
JP 2015029943 A * 2/2015

OTHER PUBLICATIONS

Written Opinion Corresponding to PCT/EP2016/056216 dated Jul. 5, 2016.

* cited by examiner

DEVICE AND METHOD FOR MIXING, IN PARTICULAR DISPERSING

The present invention relates to a device and to a method for mixing, in particular dispersing, in accordance with the preamble of the independent claims.

In practice, for example, in the paint industry, a predefined amount of liquid is frequently pre-mixed with a predefined amount of a powdery solid, as a rule pigment. Mixtures of this type are subsequently ground further, where necessary, in agitator mills and dispersed. The production of paints and lacquers or similar is an example of industrial applications.

The term mixing in the present case is understood as meaning combining materials or material flows in such a manner that as uniform a composition as possible is achieved; within the scope of the invention, the mixing serves in particular for producing dispersions, that is to say for dispersing. The term dispersion is understood here as meaning a heterogeneous mixture produced from at least two materials which do not dissolve or scarcely dissolve into one another or bond chemically with one another. During the dispersing operation, a material (disperse phase) is distributed as finely as possible into another material (dispersing agent or continuous phase), optionally by using grinding aids; ball-shaped grinding aids are frequently used, for example, in agitator mills. The present invention relates above all to (the production of) suspensions, that is to say dispersions where a liquid forms the continuous phase and a solid forms the disperse phase. In addition to the uniform distribution of the disperse phase in the continuous phase, the term dispersing is also understood as meaning the wetting of the material to be dispersed (and optionally the subsequent stabilization). Crushing can typically be the dissolving of agglomerates into primary particles. Aggregates or associates (if condensing is brought about by van-der-Waals forces or stronger chemical types of formation) can also be crushed into primary particles, however, during the dispersing. Whereas the dissolving of agglomerates can also occur in devices without grinding aids, as in a disperser or dissolver, devices with grinding aids, such as, for example, an agitator mill with ball-shaped grinding aids, are required to crush aggregates or crystals. Aggregates in the broader sense can also be understood here as meaning larger crystalline or amorphous structures. Where aggregates, crystalline or amorphous structures are crushed, true crushing is referred to.

Device of the type in question for mixing two materials, in particular a liquid and a solid, such as, for example, a powder, normally have a housing and a rotor which rotates therein. The materials are introduced into the housing by means of at least one feed line. During an operation of the device, the materials are mixed by means of the rotor and are then conducted out of the housing.

A device for dispersing, and an associated method are described in U.S. Pat. No. 6,029,853. The device for dispersing comprises a chamber for dispersing, at least one agitating disk, an inlet through which the liquid with the material to be treated and the dispersion medium are sucked in as a result of rotation of the agitating disk, an outlet and a separating device. The separating device is arranged at the outlet. The grinding aids are separated from the dispersion by means of the separating device. In addition, the separating device can leave the dispersion through the outlet, with the grinding aids being retained, as described.

DE 10 2010 053 484 discloses an agitator bead mill with a separating device for grinding aids, wherein the separating device is arranged about an axis of rotation. The separating device consists of two components, wherein one component is at least one separating device and a second component is a dynamic element for generating a material flow. The device comprises a very small dynamic gap as a separating device, and therefore the output is reduced.

DE 1 507 493 discloses an agitator bead mill with disk-shaped agitating tools in a cylindrical housing, wherein one or two disks are fitted above the rotor and, with stator elements, produce dynamic gaps. The output is also greatly limited here by the small number of outlet gaps. Furthermore, the possibility of discharging the mixture from the device is possible only very locally.

DE 35 21 668 discloses an agitator mill in which the separating device for separating off the grinding bodies consists of a sieve. Such a sieve can easily become blocked and therefore increases the maintenance frequency of the device.

It is therefore the object of the present invention to avoid the disadvantages of the prior art and in particular to create a device and a method for mixing, dispersing and in particular for separating off grinding aids, the device enabling a high throughput of material and at the same time reducing the probability of a blockage or clogging up of a flow.

The object is achieved by a device and a method for mixing as claimed in the characterizing part of the independent claims.

In particular, the object is achieved by a device for mixing, in particular dispersing, which comprises the following features:

- a housing with at least one inlet,
- a first process region for mixing supplied materials, wherein the materials can be introduced into the first process region through the at least one inlet,
- a second process region for diverting the mixture to an outlet,
- a first gap-forming element, preferably a rotor, which is assigned to the first process region and comprises openings,
- a second gap-forming element, preferably a stator, which is assigned to the second process region and corresponds to the first gap-forming element, wherein the second gap-forming element comprises openings,
- wherein at least one of the gap-forming elements, preferably the rotor, is designed so as to be rotatable about an axis of rotation relative to the other gap-forming element.

The openings of the first gap-forming element and the openings of the second gap-forming element are arranged in such a manner that a mixture produced from the supplied materials is conductible from the first process region into the second process region through the openings in the two gap-forming elements.

A device of this type results in a high throughput without there being any risk of a blockage.

The gap-forming elements have to be rotatable relative to each other, and therefore both elements can also be designed in a rotatable manner. In this case, the rotational speeds and/or the direction of rotation have to differ.

The openings in the gap-forming elements are preferably arranged in such a manner that the openings do not overlap and material can only pass from the openings of the first gap-forming element to the openings of the second gap-forming element through a gap between the openings. Once the gap has been passed, the openings are intended to enable a large material flow and therefore have an opening diameter/opening cross section which is large compared to the gap.

The gap according to the invention is formed between the two gap-forming elements. The smallest extent of the openings in the first gap-forming element is preferably at least three times as large as the largest extent of the gap between the two gap-forming elements. In addition, the smallest extent of the openings in the second gap-forming element is preferably also at least three times as large as the largest extent of the gap between the two gap-forming elements. For an embodiment in which the second gap-forming element comprises annular gaps, the extents of the annular gaps obviously have to substantially correspond to the extent of the gap between the gap-forming elements or have to be smaller than the gap between the gap-forming elements. In an embodiment with annular gaps of a gap-forming element, a high throughput is achieved by means of a high number of annular gaps. The gap according to the invention between the first gap-forming element and the second gap-forming element has a separating function. The extent of the gap prevents particles which are larger than the gap from passing into the second process region.

At least one, preferably two, preferably dynamic, gaps can be formed between the housing and the first gap-forming element.

Consequently, elements which are too large are also prevented from passing between the housing and the first gap-forming element. Nevertheless, further separating devices are not necessary.

The first gap-forming element can surround the second gap-forming element and a gap of a maximum of 3 mm, preferably 1.0 mm and particularly preferably 0.5 mm, can be formed between the two elements. The minimum gap has a transverse extent of 0.1 mm.

In particular, a gap, the maximum extent of which is smaller than the smallest element of the grinding bodies which are pourable or poured into the device, is formed between the two gap-forming elements. The gap is preferably a maximum of half the size of the diameter of the smallest grinding body.

Grinding tools which are designed for mixing or dispersing the materials introduced in the first process region can be arranged on the first gap-forming element and/or on the housing.

Grinding tools of this type can be pins or disks or other known embodiments of grinding tools.

The effectiveness of the dispersing is increased by means of grinding tools. The first gap-forming element is preferably designed as a rotor, and therefore the movement of the supplied materials and possibly of the grinding bodies is generated by means of the grinding tools on the rotor and dispersion is thus achieved in the first process region. The first gap-forming element can extend substantially completely along a length of the first process region.

Consequently, a large surface is provided with gaps which cannot clog up and still achieve a large flow rate.

Grinding bodies, the forwarding of which into the second process region is preventable by means of gaps, in particular dynamic gaps, can be pourable into the first process region.

The dynamic gaps can be formed between the first gap-forming element and the second gap-forming element and additionally between the first gap-forming element and the housing. Therefore, only material which has been completely dispersed passes into the second process region, and the movement at the gap edges means that the gaps cannot be blocked.

Preferably, no static separating device is formed between the first and the second process region.

Consequently, the static separating device cannot be blocked. A static separating device is a separating device where the edges of the openings through which the mixture passes do not move. Static separating devices are therefore in particular fixedly mounted sieves.

Alternatively, the second gap-forming element can be designed as a static separating device, wherein the openings in the static separating device are preferably smaller than the minimum diameter of the grinding bodies. Particularly preferably, the openings in the static separating device are formed by annular gaps.

A static separating device of this type reliably holds back grinding bodies and oversized particles from the second process region.

Both gap-forming elements can be formed in a cylindrical or conical manner.

Consequently, a large surface can be obtained for the passage from the first into the second process region along with a high level of rotational energy at the same time.

Alternatively, it would be conceivable to design the gap-forming elements as circular disks which are arranged between the first and the second process region.

The gap between the first gap-forming element and the second gap-forming element can have a longitudinal extent which is formed parallel to the axis of rotation. Where there are circular-disk-shaped gap-forming elements, the gap can be formed substantially perpendicular to the axis of rotation. Where the gap-forming elements are conical, the gap can be at an angle of between 1° and 89° with respect to the axis of rotation.

Consequently, reliable separation of the grinding aids can be achieved without blockages being possible.

The openings of the gap-forming elements can extend along a length of at least 50%, preferably 60%, particularly preferably 70%, of the length of the first gap-forming element in the first process region.

Consequently, a high throughput can be achieved.

The relative details refer here not to the extent of the openings, but rather to the region which is provided with openings. Furthermore, two or more bores can be connected to one another at the periphery of the second gap-forming element by a groove, preferably a milled groove. The groove obviously must not overlap with the openings in the first gap-forming element. A large outflow volume can therefore be created and the mixture is rapidly discharged into the second process region.

The housing of the device can furthermore comprise a pump housing or can be connected to a pump housing which forms a pump on the housing of the device. The pump housing and the housing of the device can be formed in one piece or in multiple pieces. In the case of a multiple-piece design, the pump housing is preferably flange-mounted on the housing of the device.

A pump is arranged in the pump housing.

The required pump is therefore directly connected to the device for mixing, and only a control means and a few external lines are necessary.

The same shaft as for driving the moving gap-forming element and/or the grinding tools can be used to drive the pump.

This results in fewer individual parts and, as a result, in less complexity.

The pump housing comprises a pump inlet and a pump outlet.

The pump can be a centrifugal pump, a liquid ring pump, a side-channel pump or a positive-displacement pump, such as, for example, an impeller pump.

The object is furthermore achieved by a method for dispersing materials in a device, preferably as described above. The method comprises the steps:

introducing at least two materials, preferably a solid and a liquid, into a first process region of a device, mixing the at least two materials in the first process region to form a mixture, conducting the mixture through a gap, which is formed between a first gap-forming element and a second gap-forming element, wherein the gap-forming elements comprise openings, and wherein the two gap-forming elements move relative to each other, and the mixture is conducted from the first process region into a second process region through the gap and the openings.

With a method of this type, relatively large amounts of materials can be mixed, in particular dispersed, particularly preferably pre-dispersed, without materials blocking the separating devices and maintenance of the device being necessary.

The mixture can furthermore be additionally conducted through one or more dynamic gaps between the first gap-forming element and a housing of the device.

Consequently, a dynamic separating device which does not become blocked and at the same simplifies the design of the device is also provided between the housing and the device.

The dispersing in the first process region can be achieved by grinding bodies and/or grinding tools.

Grinding tools can be disks or pins or similar grinding tools which are already known from the prior art. Grinding bodies are hard, round or elliptical bodies which contribute to the dispersing of the material. The grinding bodies are adapted to the desired degree of dispersion and can also have a different size depending on the material which is introduced. The grinding bodies are held back by the gap/the gaps between the gap-forming elements and/or the housing.

The dispersing can be achieved by grinding bodies which have a diameter which is at least 1.5 times, preferably 3 times, in particular 10 times, larger than the largest gap as the transverse extent.

Consequently, the grinding bodies cannot pass through the gap and the gap serves as a dynamic separating device.

The mixture can be conducted through at least 4, preferably 20, particularly preferably 100, openings in the first gap-forming element.

The mixture can furthermore be conducted through at least 4, preferably at least 50, particularly preferably a minimum of 200, openings in the second gap-forming element.

Consequently, an optimized throughput of mixture can be achieved by means of the number of openings. The openings in the second gap-forming element can be formed at least in part by bores.

Furthermore, two or more bores can be connected to each other on the periphery by a groove, preferably a milled groove. The groove obviously must not overlap with the openings in the first gap-forming element. A large outflow volume can therefore be created and the mixture is rapidly discharged into the second process region.

Figure 2:
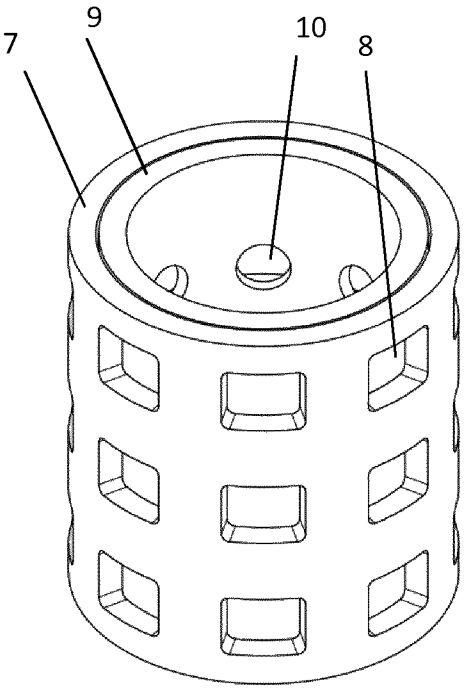
Figure 1:
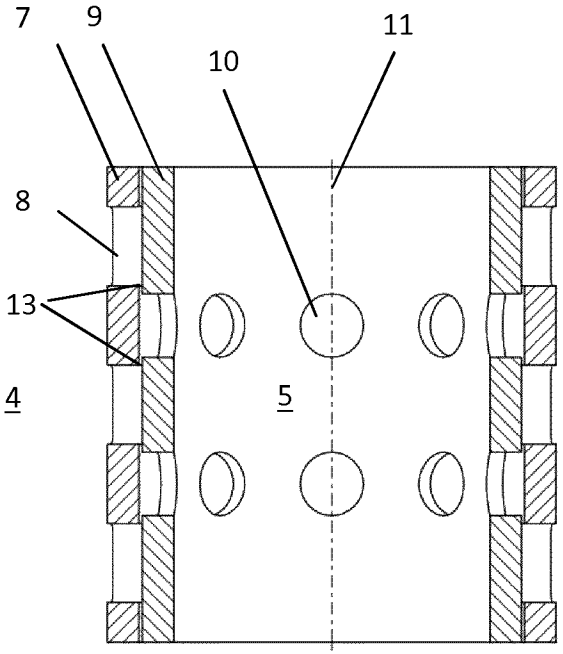
Figures 4, 5, 6, 7:
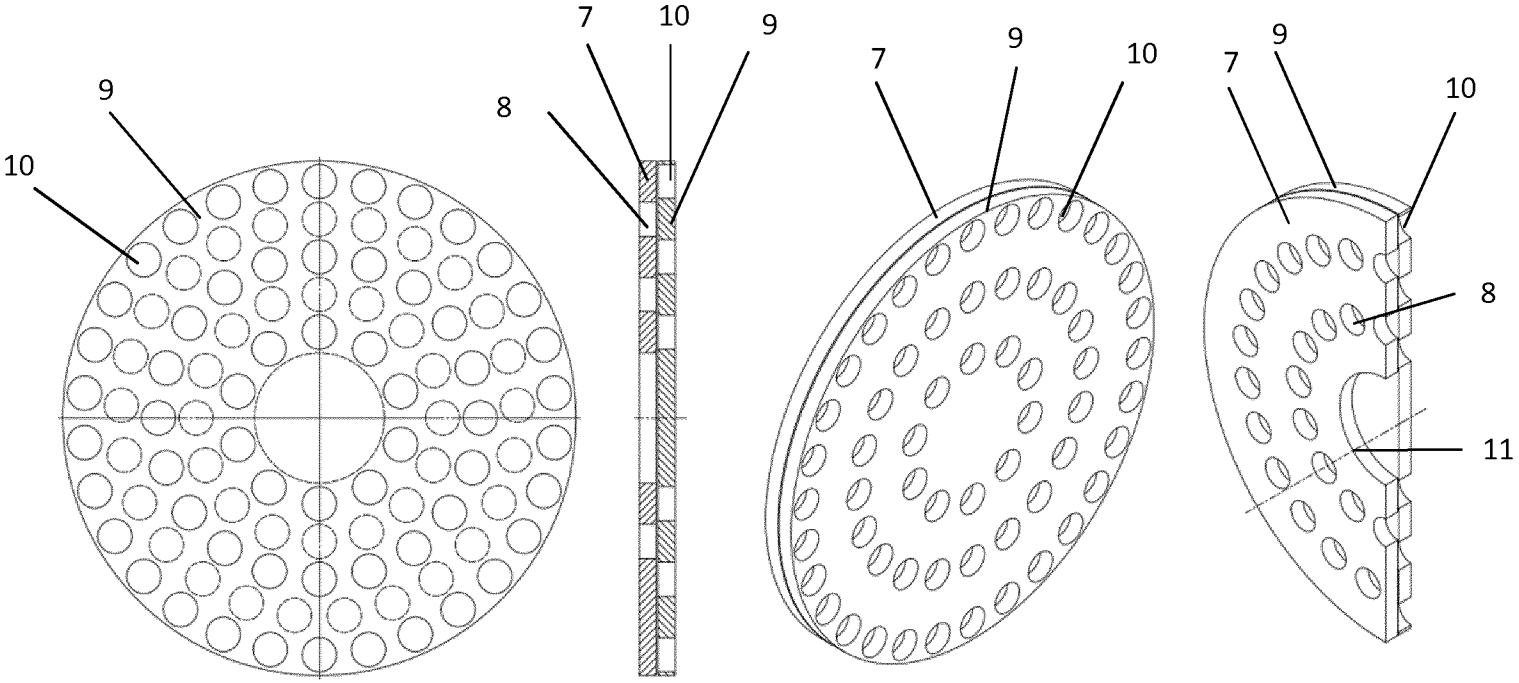
Figure 10:
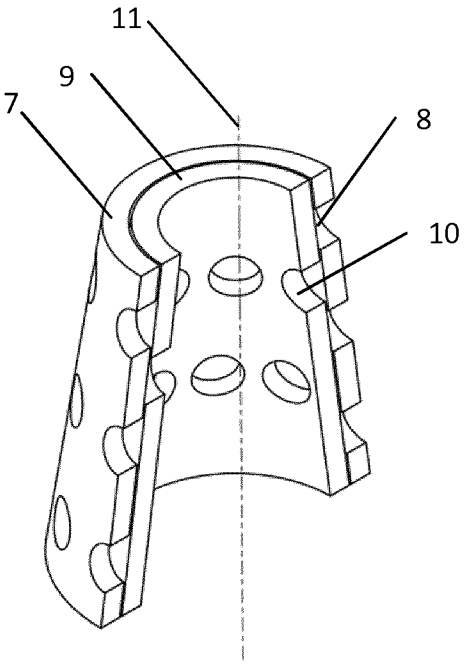
Figure 9:
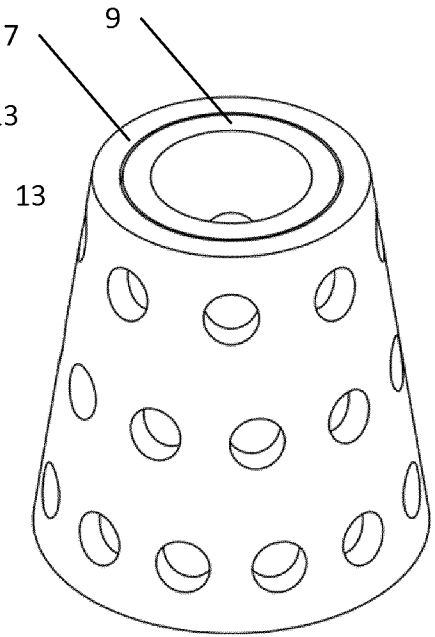
Figure 8:
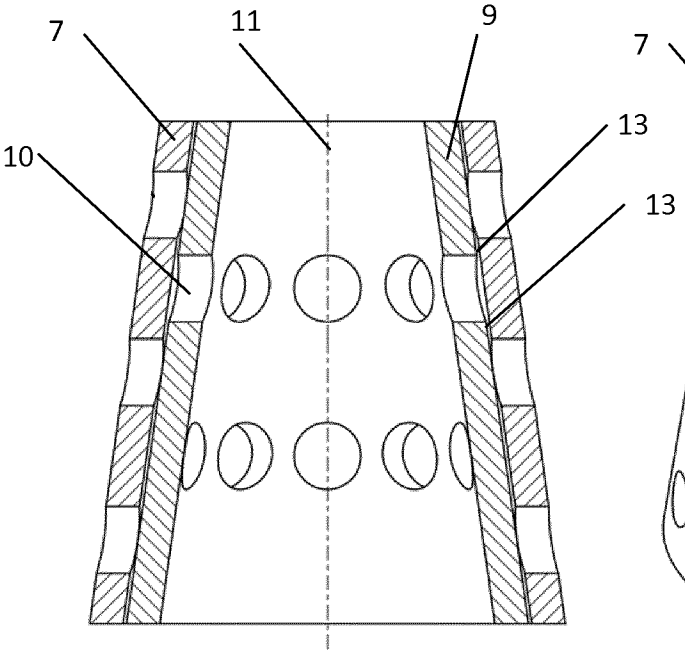
Figure 13:
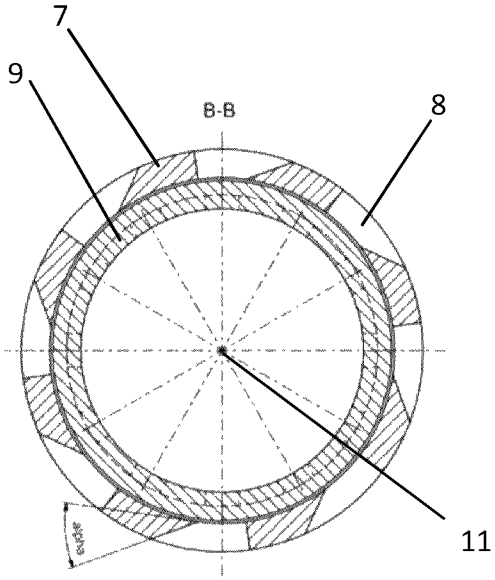
Figure 12:
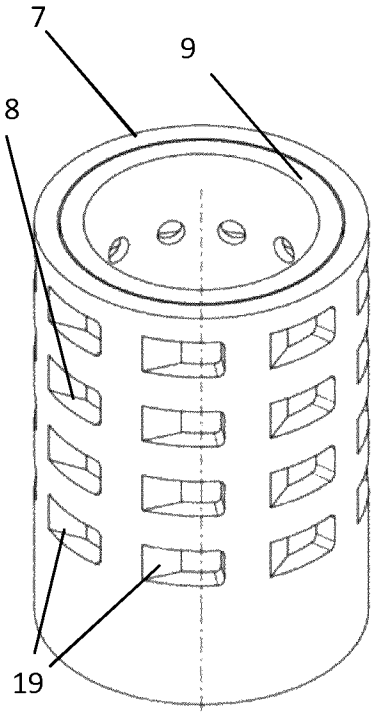
Figure 11:
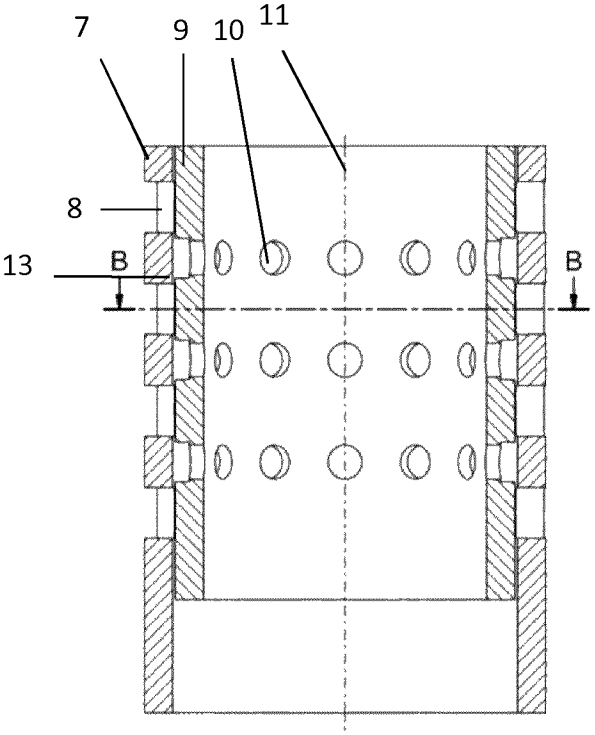
Figure 16:
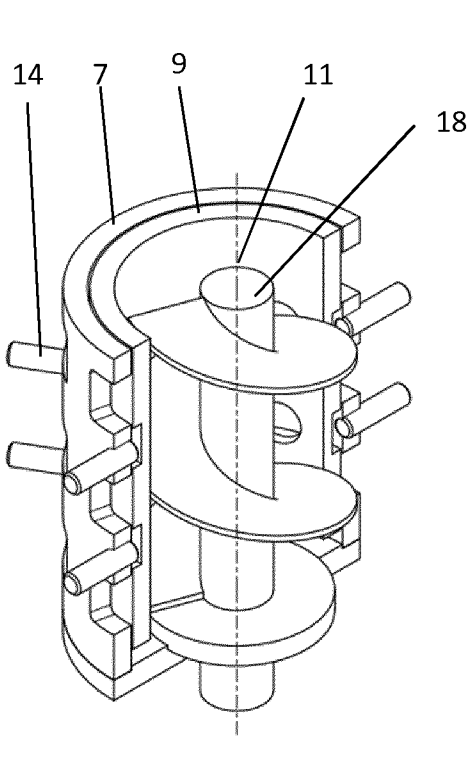
Figure 15:
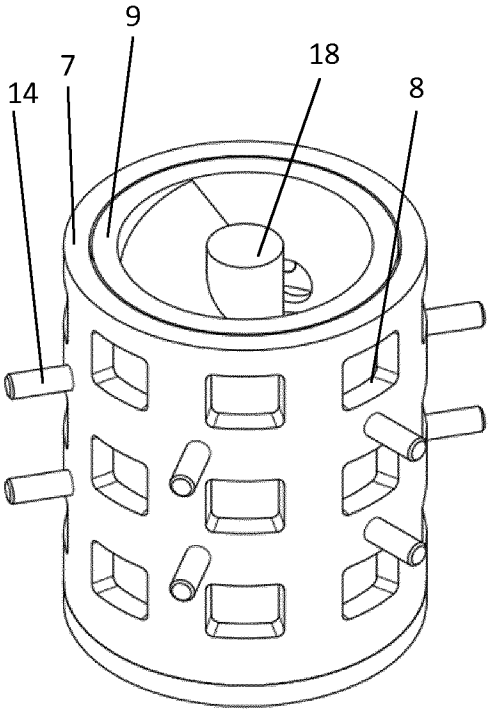
Figure 14:
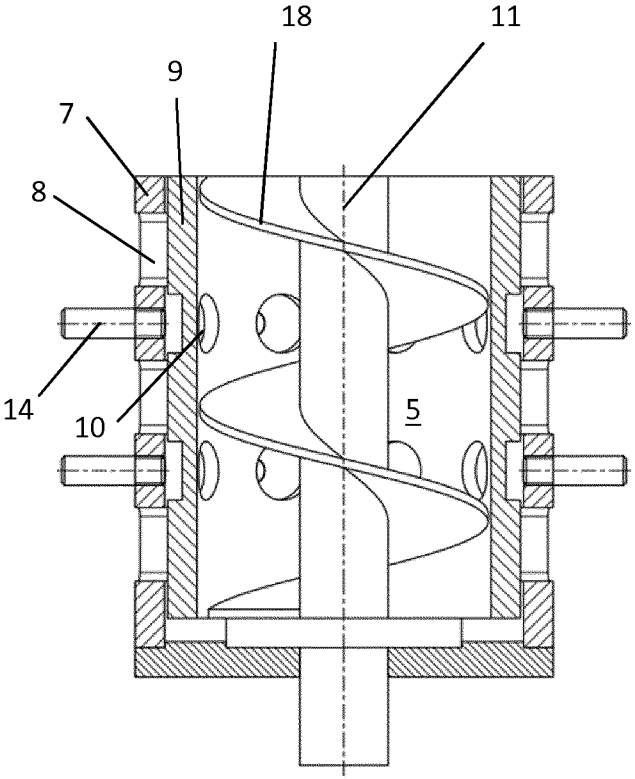
Figure 18:
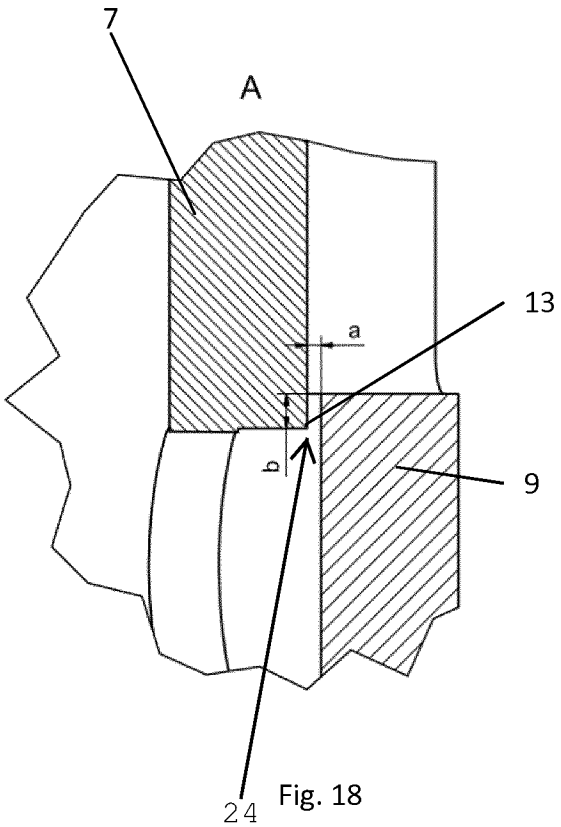
Figure 17:
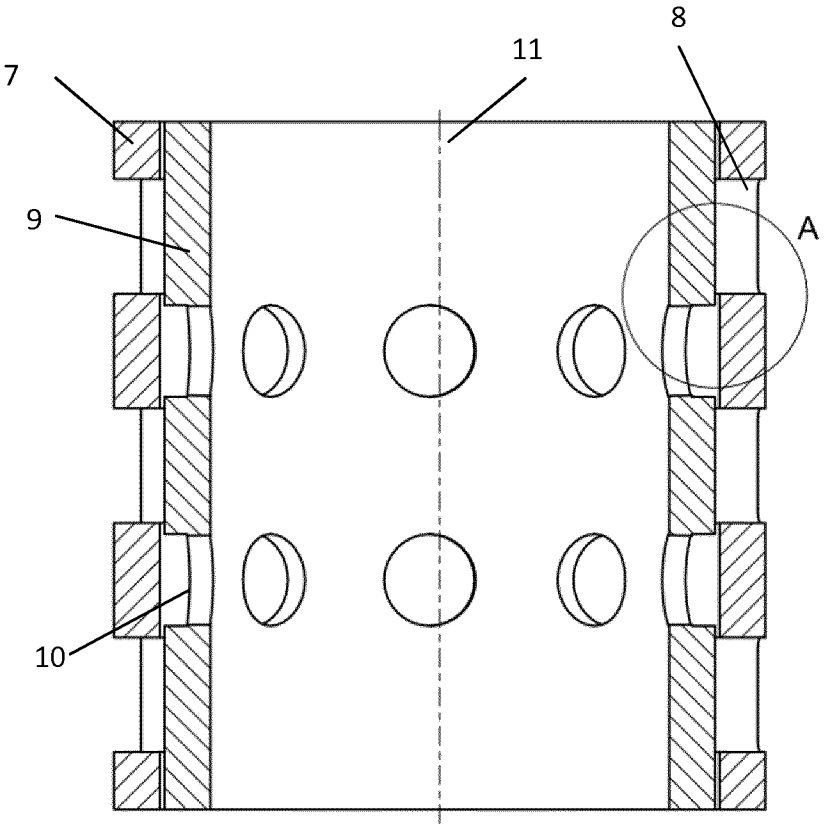
Figure 21:
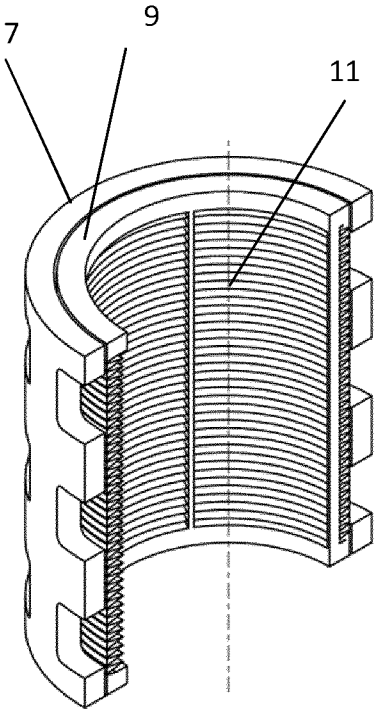
Figure 20:
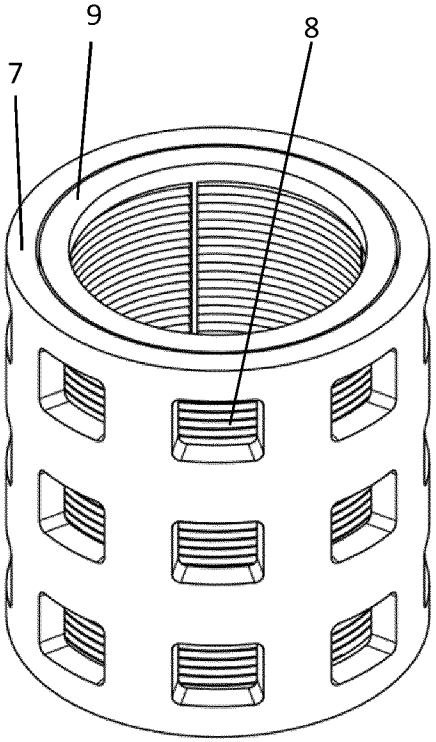
Figure 19:
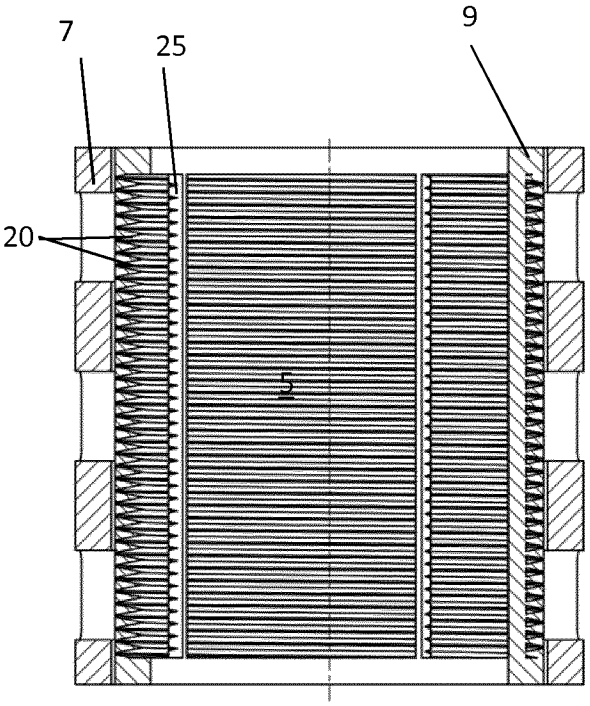
Figure 24:
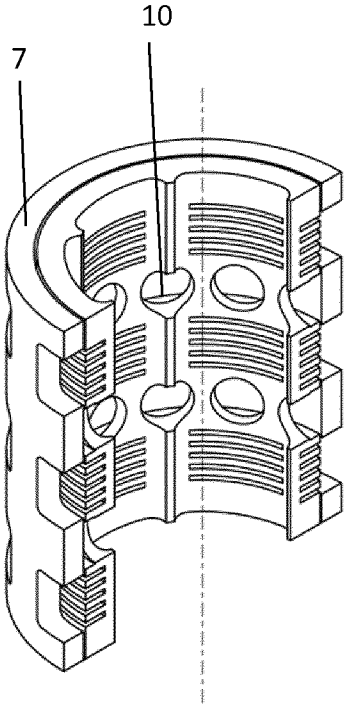
Figure 23:
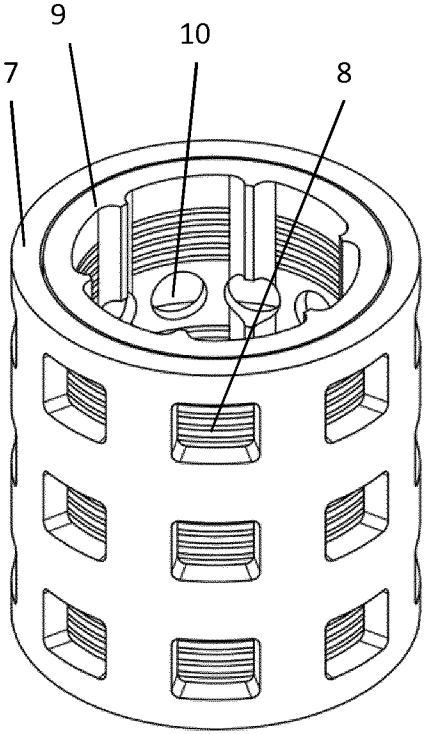
Figure 22:
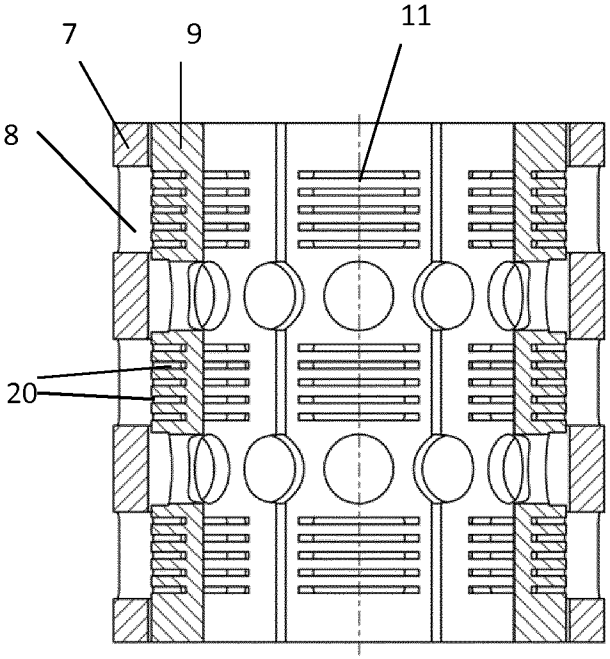
Figure 26:
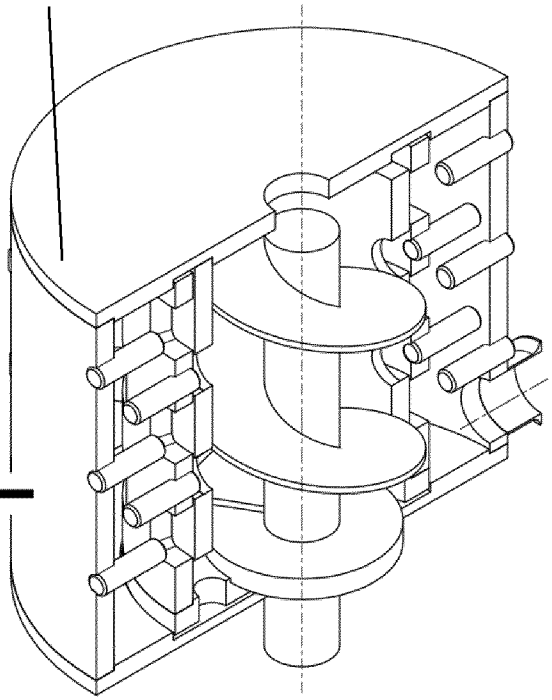
Figure 25:
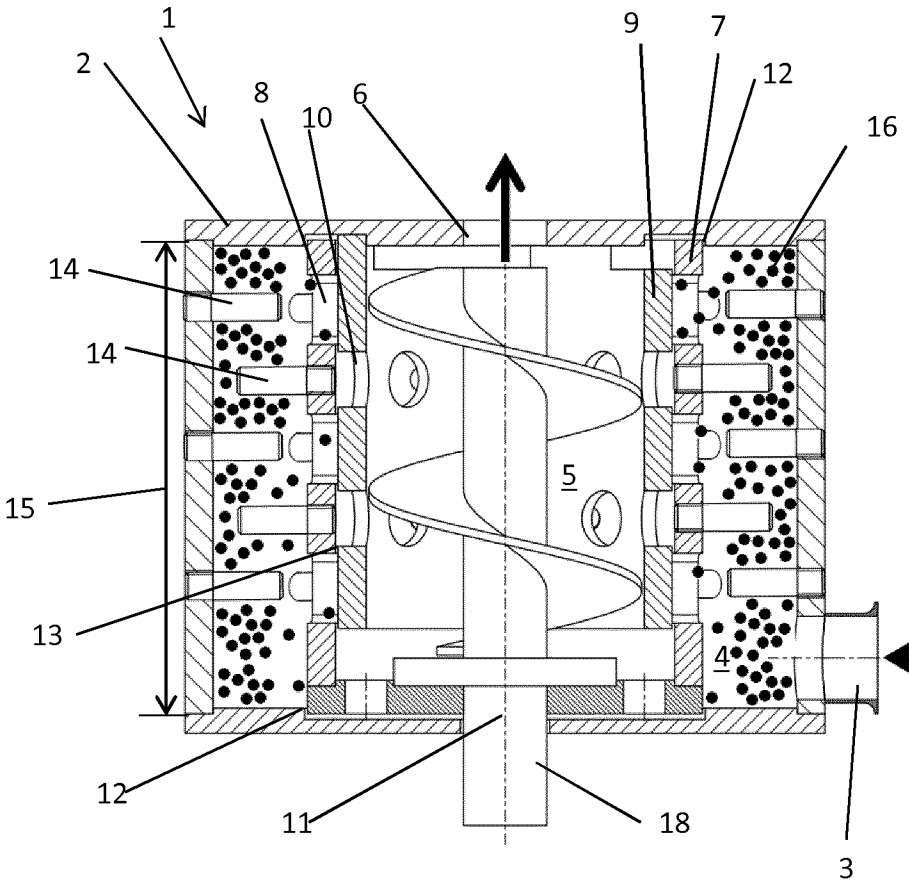
Figure 28:
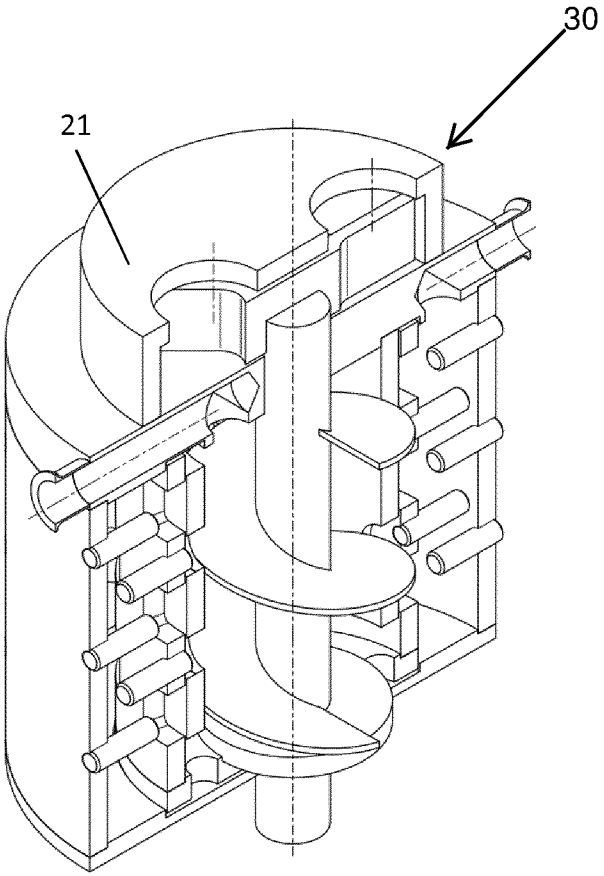
Figure 27:
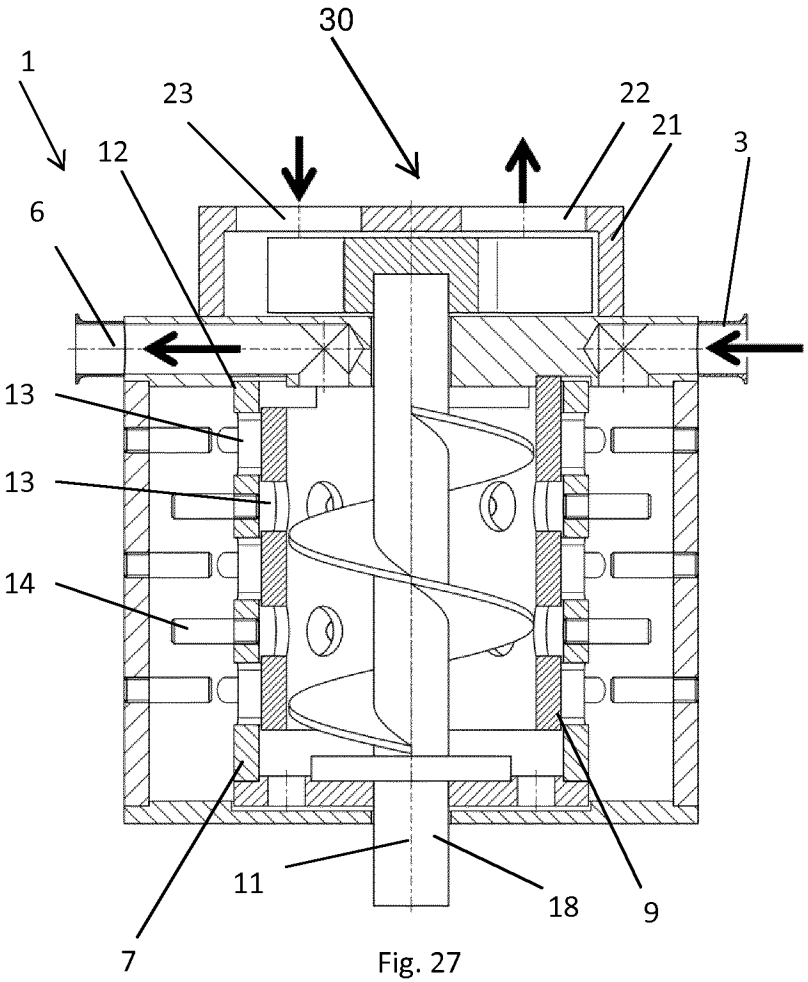
Figure 30:
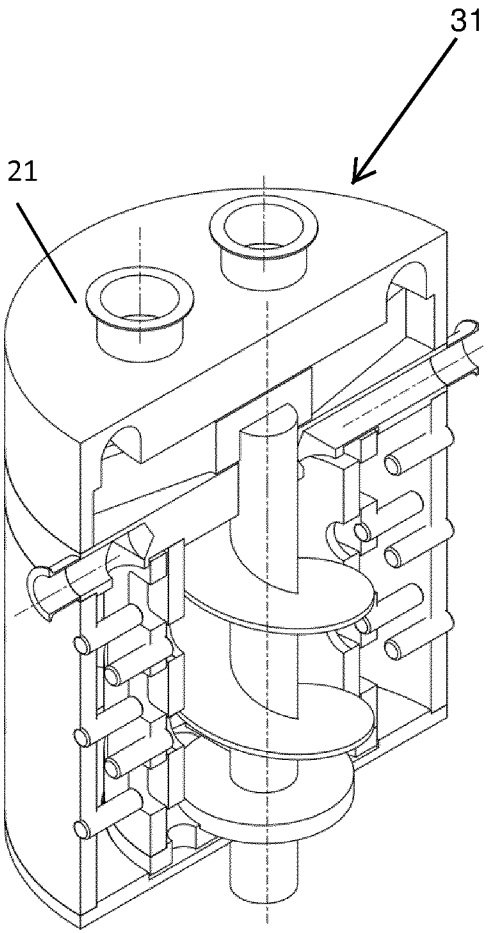
Figure 29:
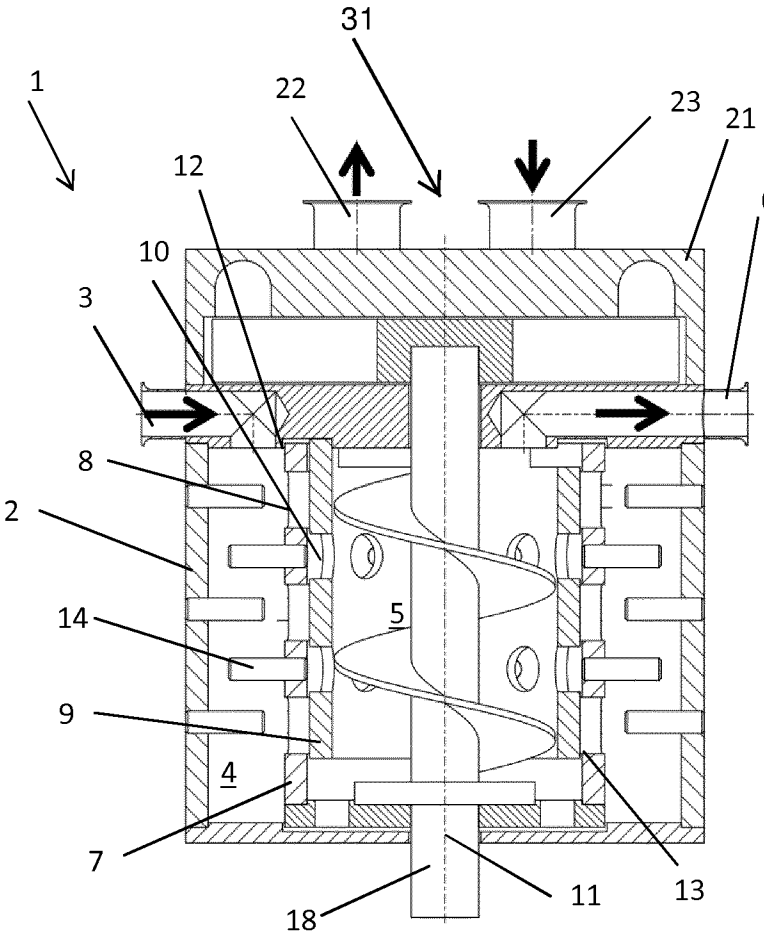
Figure 31:
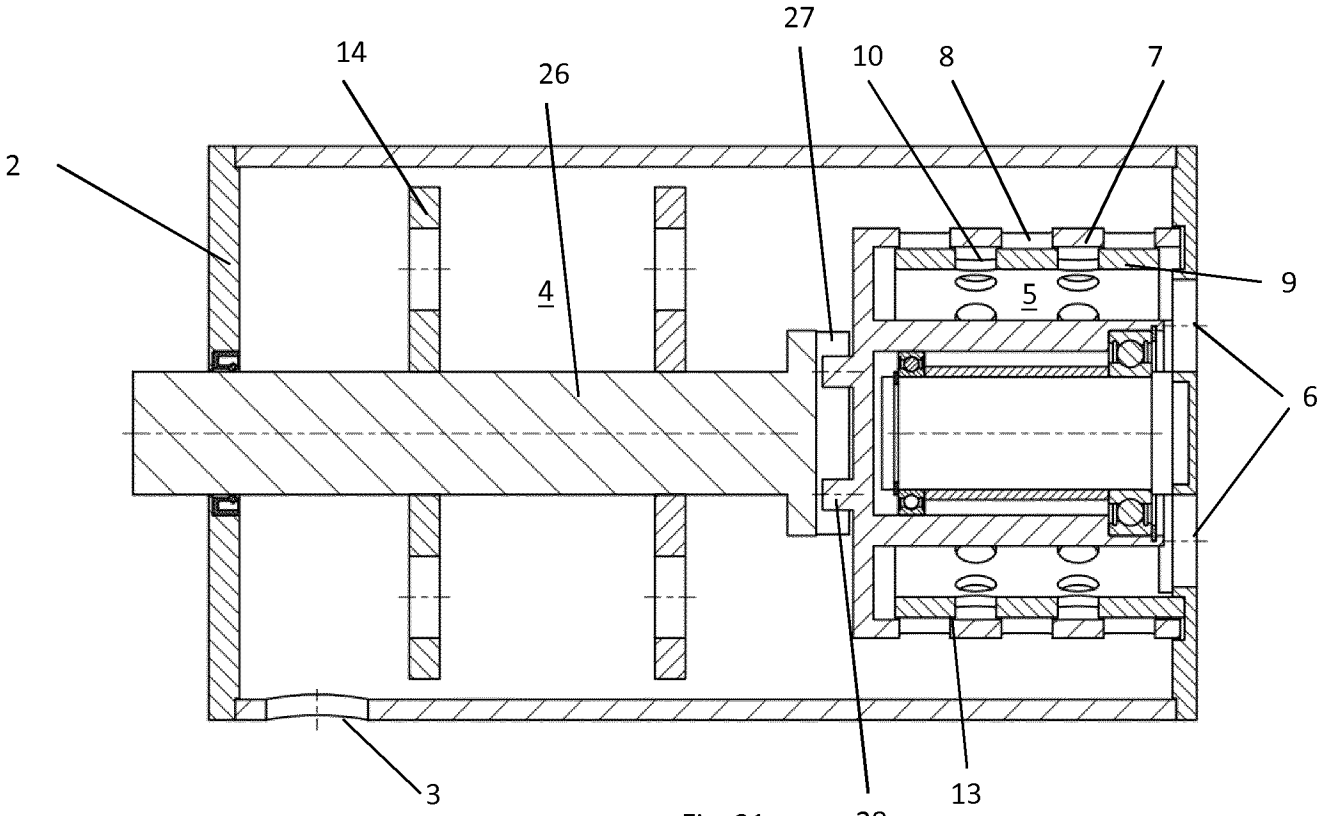

The invention is explained in more detail below with reference to figures, in which:

FIG. 1: shows a section through a first and a second gap-forming element,

FIG. 2: shows a view of a first embodiment according to FIG. 1,

FIG. 3: shows a view of a section through a first embodiment according to FIG. 1, FIG. 4: shows a view of a second embodiment of a first and second gap-forming element, FIG. 5: shows a section through a second embodiment according to FIG. 4, FIG. 6: shows an oblique view of a second embodiment according to FIG. 4, FIG. 7: shows a view of a section of a second embodiment according to FIG. 4, FIG. 8: shows a section through a third embodiment of a first and second gap-forming element, FIG. 9: shows a view of a third embodiment according to FIG. 8, FIG. 10: shows a view of a section of a third embodiment according to FIG. 8, FIG. 11: shows a section through a fourth embodiment of a first and second gap-forming element, FIG. 12: shows a view of a fourth embodiment according to FIG. 11, FIG. 13: shows a view of a section through a fourth embodiment according to FIG. 11, FIG. 14: shows a section through an embodiment of the first and second gap-forming element with a conveying element, FIG. 15: shows a view of a device from FIG. 14, FIG. 16: shows a view of a section through a device from FIG. 14, FIG. 17: shows a section through a first embodiment of a first and second gap-forming element, FIG. 18: shows a detail from FIG. 17, FIG. 19: shows a section through a fifth embodiment of a first and second gap-forming element, FIG. 20: shows a view from the device from FIG. 19, FIG. 21: shows a view of a section from the device from FIG. 19, FIG. 22: shows a section from a sixth embodiment of a first and second gap-forming element, FIG. 23: shows a view of a device from FIG. 22, FIG. 24: shows a view of a section of a device from FIG. 22, FIG. 25: shows a section through a device according to the invention, FIG. 26: shows a view of a section from FIG. 25, FIG. 27: shows a second embodiment of a device according to the invention, FIG. 28: shows a view of a section from a device from FIG. 27, FIG. 29: shows a section through a third embodiment of the device according to the invention, FIG. 30: shows a view of a section of the device from FIG. 29, FIG. 31: shows a section through a third embodiment of the device according to the invention.

FIGS. 1 to 13 each show various views of various embodiments of the gap-forming elements 7, 9. Each of these embodiments can be installed in a housing 2 of a device 1.

FIGS. 1 to 3 show a first embodiment of the gap-forming elements 7, 9. FIG. 1 shows in this connection a section, FIG. 2 a view and FIG. 3 a view of a section. The first gap-forming element 7 is formed in a cylindrical manner and surrounds the second gap-forming element 9. The second gap-forming element 9 is also formed in a cylindrical manner. The first gap-forming element 7 comprises openings 8 which are formed in a rectangular manner, wherein the corners of the openings 8 have been rounded. The second gap-forming element 9 comprises openings 10 which are formed in a round manner. The openings 8 and the openings 10 do not overlap. Gaps 13 are formed between the openings 8 and the openings 10. At least one of the two gap-forming elements 7, 9 is formed rotatably about the axis of rotation 11. Dynamic gaps 13 therefore arise. The first gap-forming element 7 is directed toward the first process region 4, while the second gap-forming element 9 is directed toward the second process region 5. The second gap-forming element 9 furthermore comprises a connecting groove 29 which connects the openings 10 along the periphery of the second gap-forming element. Improved transporting away of the mixture after passage through the gap is therefore made possible. The connecting groove 29 also does not overlap with the openings 8 of the first gap-forming element 7. The openings 8 have an extent of 15×30 mm, the openings 10 have a diameter of 12 mm in the region of the bore. Furthermore, the openings 10 are connected in the circumferential direction by a groove which has an extent of 13 mm. The necessary extent of the openings 8, 10 is at least three times the largest diameter of the grinding bodies used, if grinding bodies are used.

FIGS. 4 to 7 show a second embodiment of the gap-forming elements 7, 9. FIG. 4 shows in this connection a view, FIG. 5 a section, FIG. 6 an oblique view and FIG. 7 a view of a section. The two gap-forming elements 7 and 9 are formed in the shape of circular disks. The first gap-forming element 7 comprises openings 8 which are formed in a round manner. The second gap-forming element 9 comprises openings 10 which are likewise formed in a round manner. The openings 8 do not overlap with the openings 10. Consequently, a gap 13 is produced through which the mixture can pass from the first process region 4 (not illustrated) into the second process region 5 (not illustrated). At least one of the gap-forming elements 7, 9 is formed rotatably about the axis of rotation 11. FIGS. 8 to 10 show a third embodiment of the gap-forming elements 7, 9. FIG. 8 shows in this connection a section 9, FIG. 9 a view and FIG. 10 a view of a section. The first gap-forming element 7 is directed toward the first process region 4 (not illustrated) and the second gap-forming element 9 is directed toward the second process region 5. The first gap-forming element 7 comprises openings 8 which are formed in a round manner. The first gap-forming element 7 completely surrounds the second gap-forming element 9, wherein both gap-forming elements 7 and 9 are formed in a rotationally symmetrical and conical manner. The second gap-forming element 9 comprises openings 10 which are likewise formed in a round manner. At least one of the gap-forming elements 7, 9 is formed rotatably about the axis of rotation 11. The openings 8 and the openings 10 do not overlap, but rather form gaps 13 (added by way of example) through which the mixture can flow from the first process region 4 (not illustrated) into the second process region 5.

FIGS. 11 to 13 show a further embodiment of the gap-forming elements 7, 9. FIG. 11 shows in this connection a section, FIG. 12 a view and FIG. 13 a section through the plane B-B of FIG. 11. The embodiment from FIGS. 11 to 13 substantially corresponds to the embodiment of FIGS. 1 to 3 apart from the shape and the number of the openings 8. The openings 8 in the first gap-forming element 7 are shaped asymmetrically and, in a departure from the openings 8 from the embodiment of FIGS. 1 to 3, comprise a ramp 19. The ramp 19 serves as a flow-optimized embodiment for rejecting grinding bodies when the first gap-forming element 7 is designed as a rotor. The number of openings 8 is in each case eight openings 8 in the circumferential direction and four in the longitudinal direction, therefore a total of 32 openings 8 in the first gap-forming element 7. Consequently, the mixture can pass more easily into the openings 8 and a higher flow rate into the second process region 5 is achieved. The first gap-forming element 7 is designed here rotatably about the axis of rotation 11. The ramp 19 here has an inclination (alpha) to the tangent to the inside diameter of the first gap-forming element (7) of 10° to 80°, preferably 30°.

FIGS. 14 to 16 show the embodiment of the gap-forming elements 7, 9 from FIGS. 1 to 3 with grinding tools 14 and a conveying element 18. FIG. 14 here shows a section, FIG. 15 a view and FIG. 16 a view of a section. The first gap-forming element 7 comprises openings 8 and grinding tools 14. The first gap-forming element 7 is designed as a rotor, and therefore the grinding tools 14 can contribute to dispersing the materials in the first process region 4 (not illustrated). The gap-forming element 9 surrounds the second process region 5. The second gap-forming element 9 comprises openings 10. A conveying element 18 is arranged in the second process region 5 and is designed to be rotatable about the axis of rotation 11, precisely in the manner of the first gap-forming element 7, 3. The conveying element conveys the mixture out of the second process region 5 and therefore ensures a good throughput through the device.

FIG. 17 shows the embodiment from FIGS. 1 to 3 with the gap-forming elements 7, 9 and the openings 8, 10. At least one of the gap-forming elements 7, 9 is formed rotatably about the axis of rotation 11.

FIG. 18 shows a detail A from FIG. 17. The first gap-forming element 7 with the second gap-forming element 9 and the gap portion 24 formed between the gap-forming elements 7 and 9 is illustrated. The gap portion 24 has a longitudinal extent b and a transverse extent a. The longitudinal extent b lies within a range of 0.5 times a to 3 times a. In this case, the length b=2*a. The transverse extent a of the gap portion 24 is smaller than the smallest grinding body which is pourable into the first process region 4 (not illustrated). For the adaptation of the transverse extent a of the gap 24, the second gap-forming element 9 can be configured to be interchangeable, and therefore the gap 24 is designed to be adaptable to the grinding bodies 16 (not illustrated) if the grinding bodies 16 also have a different size in a first process than in a further process. The transverse extent a of the gap portion 24 corresponds to the transverse extent of the gap 13 (see FIG. 17).

FIGS. 19 to 21 show a further embodiment of the gap-forming elements 7, 9. FIG. 19 shows in this connection a section, FIG. 20 a view and FIG. 21 a view of a section. The gap-forming element 7 is formed analogously to the gap-forming element 7 from FIGS. 1 to 3. In a departure therefrom, the second gap-forming element 9 is designed in such a manner that it comprises a multiplicity of annular gaps 20. The annular gaps 20 are dimensioned in such a manner that only sufficiently dispersed material can enter the second process region 5. Furthermore, grinding bodies 16 (not illustrated) which are possibly present cannot pass out of the first process region 4 (not illustrated) through the annular gaps 20. At least one of the gap-forming elements 7, 9 is formed rotatably about the axis of rotation 11. The annular gaps 20 are stabilized by stabilizing webs 25.

FIGS. 22 to 24 show a further embodiment of the second gap-forming element 9. The first gap-forming element 7 corresponds to the first gap-forming element from FIGS. 1 to 3. FIG. 22 shows in this connection a section, FIG. 23 a view and FIG. 24 a view of a section. The first gap-forming element 7 comprises openings 8 which are formed analogously to FIGS. 1 to 3. The second gap-forming element 9 comprises openings 10 and in addition annular gaps 20. The annular gaps 20 are arranged in such a manner that they overlap with the openings 8 in the first gap-forming element 7. Only already dispersed mixture can pass through the annular gaps 20 and larger particles are held back. Consequently, this embodiment permits a greater penetration since a greater penetration volume is made possible by means of the annular gaps.

FIGS. 25 and 26 show the arrangement of a first and second gap-forming element 7, 9 according to FIGS. 14 to 16 in a device 1. FIG. 25 shows in this connection a section and FIG. 26 a view of a section. The device 1 comprises a housing 2 which includes a first gap-forming element 7 and a second gap-forming element 9. An inlet 3 into the housing 2 is formed. The materials to be mixed are introduced into the first process region 4 through the inlet 3. The first process region 4 furthermore comprises grinding bodies 16. The housing 2 is equipped with grinding tools 14 on the housing wall. Corresponding grinding tools 14 are formed on the first gap-forming element 7. The dispersed mixture passes from the first process region 4 into the second process region 5 by means of gaps 12, 13. A conveying element 18 which rotates about the axis of rotation 11 is formed in the second process region 5. Furthermore, the first gap-forming element 7 also rotates about the axis of rotation 11. From the second process region 5, the mixture is discharged from the housing through the outlet 6. The gaps 12, 13 are smaller than the diameter of the grinding bodies 16. Consequently, grinding bodies 16 cannot enter the second process region 5. The length of the first process region 15 substantially corresponds to the length of the first gap-forming element 7.

The embodiment of the device 1 in FIGS. 27 and 28 substantially corresponds to the embodiment of FIGS. 25 and 26. However, the device 1 additionally comprises a pump housing 21 of a water ring pump 30. The pump housing 21 is flange-mounted on the housing 2 and comprises a pump inlet 23 and a pump outlet 22. A pre-mix is pumped from the pump outlet 22 to the inlet 3 of the device. FIG. 27 shows in this connection a section and FIG. 28 a view of a section. The device 1 has an inlet 3 and an outlet 6 in the housing 2 in this embodiment. In contrast to the embodiment of FIGS. 25 and 26, no grinding aids are present in this embodiment. However, it is obviously possible to pour the latter in if this is desired. The first process region substantially extends along the first gap-forming element 7. A high throughput can therefore be achieved. The advantage of the simultaneous design of a pump resides in particular in the simplified control means.

FIGS. 29 and 30 show a further embodiment of the device 1. FIG. 29 shows in this connection a section and FIG. 30 a view of a section. Instead of a water ring pump 30, as shown in FIGS. 27 and 28, a side-channel pump 31 is arranged in the pump housing 21 in this embodiment. The pump housing likewise comprises a pump inlet 23 and a pump outlet 22. The pre-mix is pumped from the pump outlet 22 into the inlet 3 of the device.

Apart from the pump housing 21, the design of the device substantially corresponds to the embodiment in FIGS. 25 and 26.

FIG. 31 shows an alternative embodiment of the device 1 in which the gap-forming elements 7, 9 extend only over a partial region of the first process region 4. Furthermore, grinding tools 14 in the form of perforated disks are formed in the first process region 4. The first gap-forming element 7 rotates about the second gap-forming element 9. The two gap-forming elements 7, 9 have respective openings 8, 10. The mixture flows from the first process region 4 through the gaps 13 into the second process region 5. The housing 2 furthermore has an inlet 3 and outlets 6. The grinding tools 14 are arranged on a shaft 26. The shaft 26 comprises a shaft groove 27 in which engagement cams 28 of the first gap-forming element 7 engage. Consequently, the first gap-forming element is driven by the same shaft as the grinding tools 14.

The invention claimed is:

1. A device for mixing comprising:

a housing with at least one inlet, a first process region for mixing and dispersing supplied materials, and the materials are introduced into the first process region through the at least one inlet, a second process region for diverting a mixture to an outlet, an outwardly facing surface of a first gap forming element directly facing and partially defining the first process region and the first gap forming element comprises a plurality of openings, an inwardly facing surface of a second gap forming element directly facing and partially defining the second process region and cooperating with the first gap forming element, and the second gap forming element comprises a plurality of openings, wherein at least one of the gap forming elements is designed so as to be rotatable about an axis of rotation relative to the other gap forming element, the plurality of openings of the first gap forming element and the plurality of openings of the second gap forming element are arranged in such a manner that the plurality of openings do not overlap and the mixture, produced from the supplied materials, is conductible from the first process region into the second process region through the plurality of openings in the first and second gap forming elements such that the mixture only passes from the plurality of openings of the first gap forming element to the plurality of openings of the second gap forming element through a gap formed between the first and second gap forming elements, the first gap forming element is a rotor and the second gap forming element is designed as a static separating device, and at least one grinding tool, which is designed for dispersing the materials introduced in the first process region, is arranged on at least one of the first gap forming element and the housing, and the plurality of openings of the first and second gap forming elements extend along a length of at least 50% of the length of the first gap forming element in the first process region.

2. The device according to claim 1, wherein at least one gap is formed between the housing and the first gap forming element.

3. The device according to claim 1, wherein the first gap forming element surrounds the second gap forming element, and the gap between the gap forming elements is a maximum of 3 mm.

4. The device according to claim 1, wherein the first gap forming element extends along a length of the first process region.

5. The device according to claim 1, wherein grinding bodies, the forwarding of which into the second process region is preventable by the gap between the gap forming elements, are pourable into the first process region.

6. The device according to claim 1, wherein openings in the static separating device are smaller than the minimum diameters of grinding bodies.

7. The device according to claim 1, wherein both gap forming elements are formed in one of a cylindrical or a conical manner.

8. The device according to claim 1, wherein the housing comprises a pump housing or the housing is connected to a pump housing, and a pump is arranged in the pump housing.

9. The device according to claim 1, wherein the gap between the gap forming elements extends over a length of at least 50% of the length of the first gap forming element in the first process region.

10. The device according to claim 8, wherein the pump is driven by a shaft which, at the same time, drives one of the gap forming elements.

11. The device according to claim 8, wherein the plurality of openings of the first gap forming element and the plurality of openings of the second gap forming element are arranged in such a manner at least one of first sections between two adjacent openings of the plurality of openings of the first gap forming element and at least one of second sections between two adjacent openings of the plurality of openings of the second gap forming element overlap and form a gap portion with a longitudinal extent and a transverse extent.

12. The device according to claim 11, wherein the longitudinal extent lies within a range of half of the transverse extend and three times the transverse extend.

* * * * *